US007684168B2

(12) United States Patent
Guo et al.

(10) Patent No.: US 7,684,168 B2
(45) Date of Patent: Mar. 23, 2010

(54) CONSTANT CURRENT RELAY DRIVER WITH CONTROLLED SENSE RESISTOR

(75) Inventors: Sam Y. Guo, Canton, MI (US); Kenneth J. Russel, Westland, MI (US)

(73) Assignee: Yazaki North America, Inc., Canton, MI (US)

( * ) Notice: Subject to any disclaimer, the term of this patent is extended or adjusted under 35 U.S.C. 154(b) by 98 days.

(21) Appl. No.: 11/956,374

(22) Filed: Dec. 14, 2007

(65) Prior Publication Data

US 2008/0170348 A1 Jul. 17, 2008

Related U.S. Application Data

(60) Provisional application No. 60/884,904, filed on Jan. 15, 2007.

(51) Int. Cl.
*H01H 9/00* (2006.01)

(52) U.S. Cl. ..... 361/186; 361/160

(58) Field of Classification Search ..... 361/139, 361/143, 160, 93.7–93.9, 186
See application file for complete search history.

(56) References Cited

U.S. PATENT DOCUMENTS 3,786,314 A * 1/1974 Misch ..... 361/154
4,326,234 A 4/1982 Shuey
4,453,652 A * 6/1984 Merkel et al. ..... 222/504
4,767,840 A 8/1988 Shannon et al.
4,890,188 A 12/1989 Russell et al.
5,038,247 A 8/1991 Kelley et al.
5,082,097 A 1/1992 Goeckner et al.
5,107,391 A 4/1992 Siepmann
5,235,490 A 8/1993 Frank et al.
5,249,658 A 10/1993 Goeckner et al.
5,402,302 A 3/1995 Boucheron
5,475,561 A 12/1995 Goeckner et al.
5,914,849 A 6/1999 Perreira
5,999,396 A 12/1999 Streich
6,351,162 B1 2/2002 Schwartz
6,798,633 B1 9/2004 Rossbach
2002/0114120 A1 8/2002 Ehara
2002/0167777 A1 11/2002 Parisi et al.

FOREIGN PATENT DOCUMENTS

EP 0400389 A2 12/1990
EP 0471891 A2 2/1992

* cited by examiner

*Primary Examiner*—Danny Nguyen
(74) *Attorney, Agent, or Firm*—Harness, Dickey & Pierce, P.L.C.

(57) ABSTRACT

The present teachings generally include a method of controlling a relay. The method generally includes momentarily initiating a pull-in pulse when an input signal indicates a first state. A sense resistor controller is activated based on the pull-in pulse. A current flow is controlled to bypass a sense resistor and flow to the relay based on the activation of the sense resistor controller. The relay is controlled based on the current flow.

14 Claims, 3 Drawing Sheets

CONSTANT CURRENT RELAY DRIVER WITH CONTROLLED SENSE RESISTOR

CROSS-REFERENCE TO RELATED APPLICATIONS

This application claims the benefit of U.S. Provisional Application No. 60/884,904 filed on Jan. 15, 2007. The disclosure of the above application is incorporated herein by reference.

FIELD

The present disclosure relates to methods and systems for controlling current to mechanical relays.

BACKGROUND

Coils in mechanical relays generate heat. When a relay is activated, the relay needs large current to pull in the armature. Once the armature is pulled in, only a small current is needed to hold the armature in place.

Relay manufacturers design relays such that they can operate under various operating scenarios. It is known that coil resistance increases with temperature. Instead of taking into account the actual temperature, current supplied to operate the armature of the relay is operated at above normal requirements to ensure operation at all temperatures. In some cases, during normal operating conditions current supplied to operate the armature can be more than double the requirement (i.e., to accommodate for high ambient air temperatures). The excess energy is then dissipated as heat. This excess heat generated by the relay coil can cause thermal problems for other electrical components. For example, power distribution center modules (PDCs) for a vehicle can include more than twenty relays. The twenty relays can provide enough heat to affect the operation of other electrical components within the vehicle.

SUMMARY

The present teachings generally include a method of controlling a relay. The method generally includes momentarily initiating a pull-in pulse when an input signal indicates a first state. A sense resistor controller is activated based on the pull-in pulse. A current flow is controlled to bypass a sense resistor and flow to the relay based on the activation of the sense resistor controller. The relay is controlled based on the current flow.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
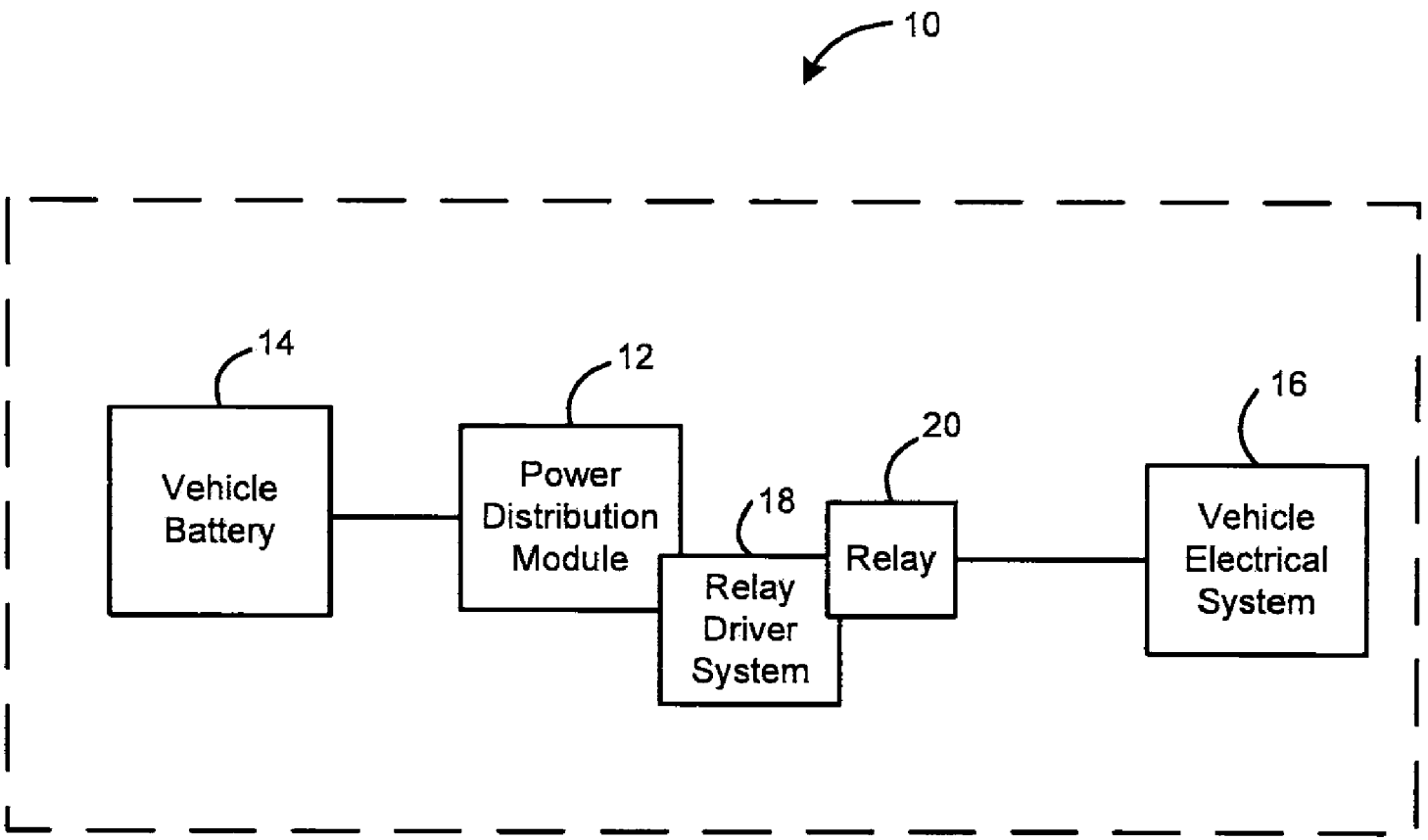
FIG. 1 is a block diagram of a vehicle including a power distribution center in accordance with various aspects of the present teachings.

The following description is merely exemplary in nature and is not intended to limit the present teachings, their application, or uses. It should be understood that throughout the drawings, corresponding reference numerals indicate like or corresponding parts and features. As used herein, the term module, control module, component and/or device can refer to one or more of the following: an application specific integrated circuit (ASIC), an electronic circuit, a processor (shared, dedicated or group) and memory that executes one or more software or firmware programs, a combinational logic circuit and/or other suitable mechanical, electrical or electromechanical components that can provide the described functionality and/or combinations thereof.

FIG. 1 illustrates a vehicle generally at 10 that can include a power distribution module 12. The power distribution module 12 can provide electrical energy from a vehicle battery 14 to various electrical systems 16 of the vehicle 10. The power distribution module 12 can include one or more instances of a relay driver system 18 that can control an armature of a relay 20 according to various aspects of the present disclosure.

Figure 2:
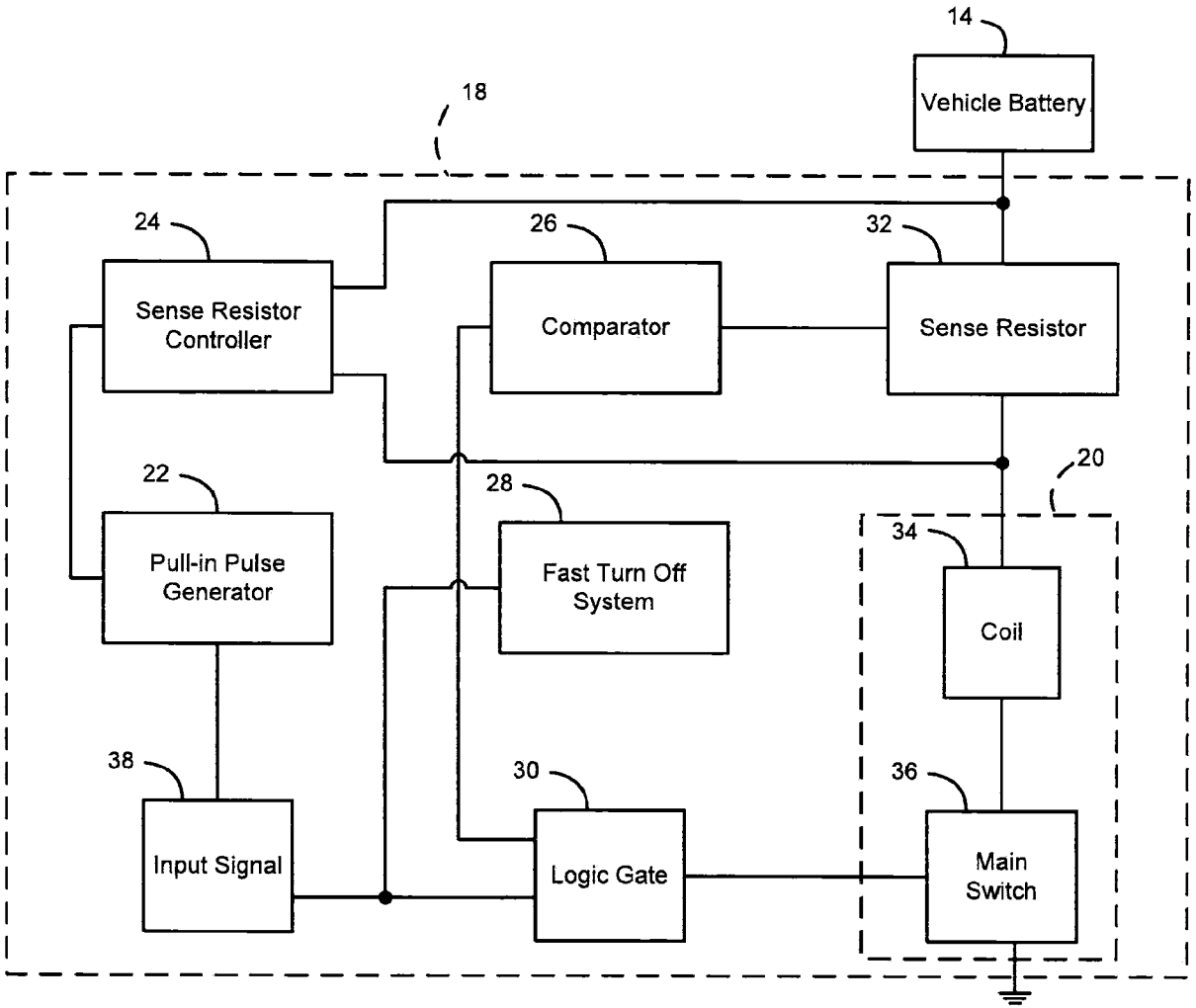
FIG. 2 is a block diagram illustrating a relay driver system in accordance with various aspects of the present teachings.

With reference to FIG. 2 and in various aspects of the present teachings, the relay driver system 18 can control the flow of current to operate the relay 20. In one aspect of the present teachings, the current flow can be controlled to provide a full battery voltage to the relay 20 during an initial pull-in period (i.e., moving an armature of the relay). In another aspect of the present teachings, after the pull-in period (i.e., a period in which the position of the armature is maintained), a voltage of the current flow is regulated such that a position of the armature of the relay 20 can be maintained without utilizing excess electrical energy and/or creating excess heat.

The relay driver system 18 shown in the example of FIG. 2 can generally include a pull-in pulse generator 22, a sense resistor controller 24, a comparator 26, a fast turn off system 28, a logic gate 30, a sense resistor 32, and the relay 20. The relay 20 can include a relay coil 34 and a main switch 36. An input signal 38 can be commanded to the relay driver system 18. Based on the input signal 38, the relay driver system 18 can control an armature of the main switch 36 while minimizing the dissipation of heat. According to various aspects of the present teachings, the current can flow from the vehicle battery 14 through various paths of the relay driver system 18 to the relay 20.

More particularly, the logic gate 30 can control the state of the main switch 36 to be ON or to be OFF. When the main switch 36 is ON, the flow of current can be regulated by the pull-in pulse generator 22, the sense resistor 32, the comparator 26, the fast turn off system 28, and/or any combinations thereof. At the beginning of relay operation, the pull-in pulse generator 22 can generate a pull-in pulse for a time at which it takes to pull in the relay armature. Based on the pull-in pulse, the sense resistor controller 24 can prevent the flow of current past the sense resistor 32 momentarily to allow full battery voltage to be applied to the relay coil 34 during the pull-in period. After the armature is pulled in, the sense resistor controller 24 can allow current to flow past the sense resistor 32 according to a first mode of operation. During the first mode of operation, the comparator 26 can compare the voltage drop across the sense resistor 32 to a reference voltage and/or hysteresis. Based on the voltage drop, the fast turn off system 28 can regulate the current flow past the relay coil 34 according to a freewheeling method as will be discussed in more detail below.

Figure 3:
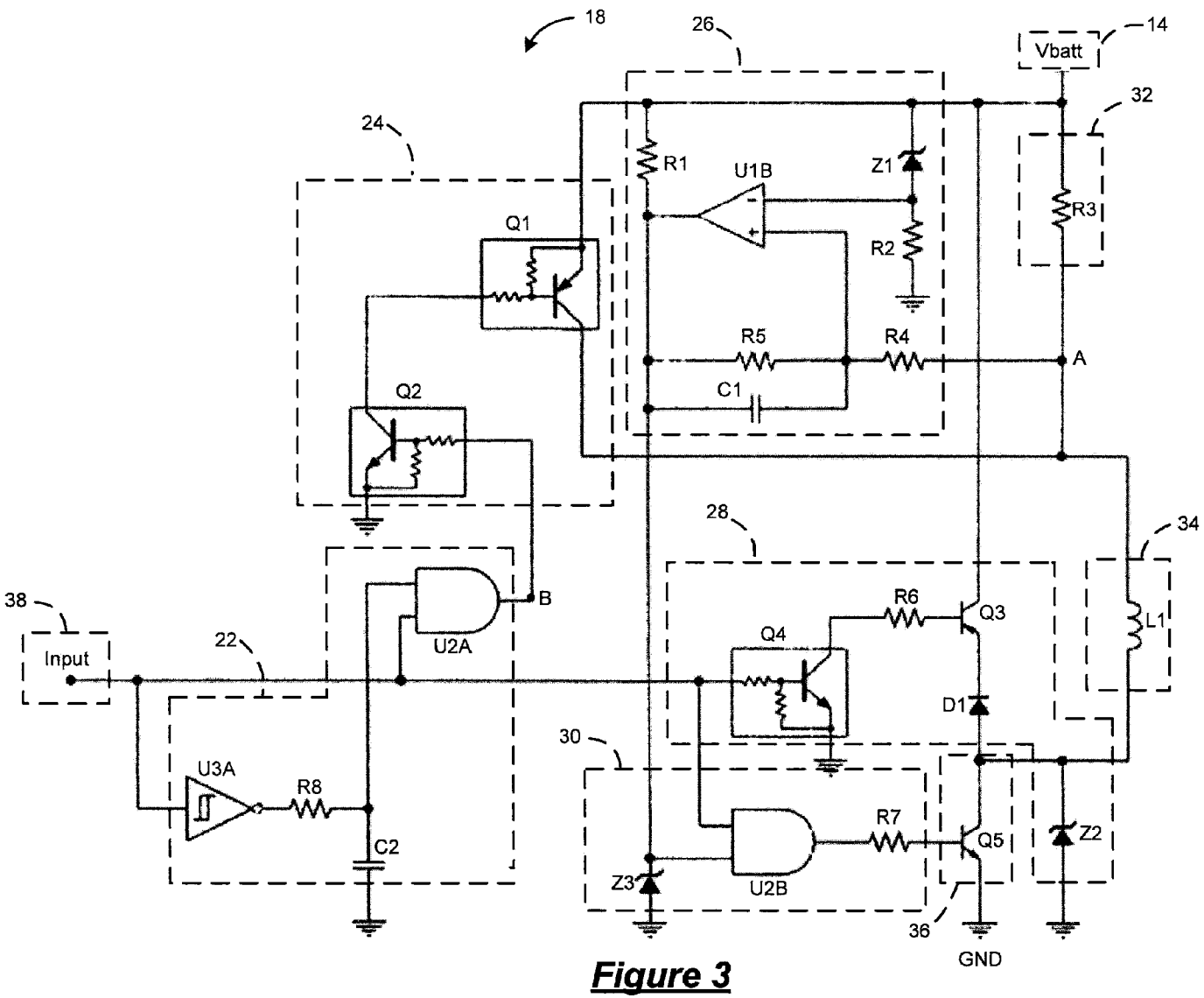
FIG. 3 is an electrical schematic illustrating an example of various aspects of a relay driver system as shown in FIG. 2.

With reference to FIG. 3, an electrical schematic illustrates an example of various aspects of the relay driver system 18 shown in FIG. 2. The relay driver system 18 can include the relay coil 34 (L1). The sense resistor 32 (R3) can sense coil current. The main switch 36 can include a switch Q5. The switch Q5 can control coil current.

The comparator 26 can include a pull-up resistor R1, a Zener diode Z1, a second resistor R2, a comparator U1B, a third resistor R4, a fourth resistor R5, and a capacitor C1. More particularly, the pull-up resistor R1 can be required for operation of the comparator U1B. The Zener diode Z1 and the second resistor R2 can provide the comparator U1B with a voltage reference. The third resistor R4, the fourth resistor R5, and the capacitor C1 can provide the comparator U1B with a hysteresis for comparison. The sense resistor controller 24 can include a first controlling transistor Q1 and a second controlling transistor Q2. The controlling transistors Q1 and Q2 can be used to control the flow of current past the sense resistor R3.

The pull-in pulse generator 22 can include a comparator U3A, a resistor R8, a capacitor C2, and a logic gate U2A. As discussed above, the pull-in pulse generator can generate a pull-in pulse at the beginning of relay operation. The logic gate 30 can include an AND gate U2B, a Zener diode Z3, and a resistor R7. The AND gate U2B can allow the input signal 38 and an output of the comparator U1B to jointly control the main switch Q5. The Zener diode Z3 can limit the output voltage of the comparator U1B to a logical range. The fast turn off system 28 can include a freewheeling diode D1, a fast turn off transistor Q4, a resistor R6, a switch Q3, and a Zener diode Z2. The freewheeling diode D1 can be controlled by the fast turn off transistor Q4, the resistor R6, and the switch Q3 to regulate current flow past the coil L1. The Zener diode Z2 can be used for fast turn off as well as reverse battery protection.

As can be appreciated in light of the disclosure the relay driver system 18 can operate according to the following methods. When the input signal 38 is low, the logic gate U2B can shut the main switch Q5 OFF. Thereby, preventing current flow through the sense resistor R3 and/or the coil L1. The relay 20 (FIG. 2) can be considered deactivated and the voltage drop across the sense resistor R3 can be zero. The output of the comparator U1B can be high thus allowing the logic gate U2B to be ready to be controlled by the input signal 38.

When the input signal 38 changes from low to high, the logic gate U2B can turn the main switch Q5 ON. At the same time, the pull-in pulse generator 22 that can include the comparator U3A and logic gate U2A can generate a high pull-in pulse at point B. The pull-in pulse can turn on the sense resistor controller 24 that can include the second controlling transistor Q2 and the first controlling transistor Q1. In this scenario, the current path can begin at Vbatt, and can flow to the controlling transistor Q1, to the coil L1, to the switch Q5, and on to the ground GND. The full battery voltage can be applied to the coil L1. The current of the coil L1 begins to ramp up.

When the input signal 38 is high, the fast turn off transistor Q4 and the switch Q3 can be ON. The diode D1 can be connected across the coil L1 through the switch Q3 and the sense resistor R3. The diode D1 can be ready to perform a freewheeling function for the coil L1. More particularly, after the pull-in pulse ends, the second controlling transistor Q2 and the first controlling transistor Q1 can be turned OFF. The current passing through the coil L1 can be shifted immediately from the first controlling current Q1 to current from the sense resistor R3. The current flowing through the sense resistor R3 can cause a voltage drop across the sense resistor R3. The voltage at point A (Va) can be below the low threshold of the comparator U1B. The output of U1B can become low. The low comparator output can turn the main switch Q5 OFF through the logic gate U2B thereby, preventing coil current from flowing through the main switch Q5. Instead, the coil current can ramp down through a new path that can begin at the bottom of the coil L1, and can flow to the diode D1, to the switch Q3, to the sense resistor R3 back to the top of the coil L1. This path can also be referred to as a freewheeling path. The voltage drop across the sense resistor R3 ramps down with the coil current and voltage at point A (Va) becomes greater (i.e. closer and closer to Vbatt).

When the voltage at point A (Va) becomes higher than the high threshold of the comparator U1B, the output of the comparator U1B can become high. This high output of the comparator U1B can turn the main switch Q5 ON through the logic gate U2B. The coil current can then begin to ramp up. For example, the coil current path can begin at Vbatt, and can flow to the sense resistor R3, to the coil L1, to the main switch Q5, and on to the ground GND.

While the coil current is ramping up, the voltage at point A (Va) can become lower and lower. When the voltage at point A (Va) becomes lower than the low threshold of the comparator U1B, the output of the comparator U1B can become low. This low comparator output can turn the main switch Q5 OFF through the logic gate U2B. This method of regulating the voltage at point A (Va) can repeat. In this way, the coil current can be regulated at a constant level much lower than the pull-in current. When battery voltage changes, or the coil temperature changes, and/or both change, the coil current level does not change.

When the input signal changes from high to low, the fast turn off transistor Q4 and the switch Q3 can be turned OFF. The freewheeling path can be removed. At the same time, the main switch Q5 can be turned OFF by the logic gate U2B. The coil current can decay to zero through a fast turn OFF path that can begin at the bottom of the coil L1, and can flow to the diode Z2, and on to the ground GND (i.e. the negative terminal of the vehicle battery), through the battery 14, to the positive terminal of the battery 14, to the sense resistor R3, to the top of the coil L1. The magnetic energy stored in the coil L1 can be discharged at a high rate. The higher the Zener break-down voltage, the higher the discharge rate and the faster the turn off process.

While specific aspects have been described in this specification and illustrated in the drawings, it will be understood by those skilled in the art that various changes can be made and equivalents can be substituted for elements thereof without departing from the scope of the present teachings, as defined in the claims. Furthermore, the mixing and matching of features, elements and/or functions between various aspects of the present teachings may be expressly contemplated herein so that one skilled in the art will appreciate from the present teachings that features, elements and/or functions of one aspect of the present teachings may be incorporated into another aspect, as appropriate, unless described otherwise above. Moreover, many modifications may be made to adapt a particular situation, configuration or material to the present teachings without departing from the essential scope thereof. Therefore, it is intended that the present teachings not be limited to the particular aspects illustrated by the drawings and described in the specification as the best mode presently contemplated for carrying out the present teachings but that the scope of the present teachings will include many aspects and examples following within the foregoing description and the appended claims.

What is claimed is:

1. A method of controlling a relay, the method comprising:

momentarily initiating a pull-in pulse when an input signal indicates a first state;

activating a sense resistor controller based on the pull-in pulse;

controlling current flow to bypass a sense resistor and to flow to the relay based on the activation of the sense resistor controller; and controlling the relay based on the current flow.

2. The method of claim 1 further comprising:

after the pull-in pulse completes, deactivating the sense resistor controller;

controlling current to flow past the sense resistor;

sensing a relay current based on the sense resistor; and regulating current flow based on the sensed relay current.

3. The method of claim 1 further comprising controlling current through a fast turn off path when the input signal changes to a second state.

4. The method of claim 2 wherein the regulating comprises controlling current through a freewheeling path based on the sensed relay current.

5. The method of claim 4 wherein the controlling current through the freewheeling path comprises controlling current through the freewheeling path instead of to the relay, to allow the sensed relay current to ramp down.

6. A control system that controls a relay, the system comprising:

a sense resistor that selectively communicates with the relay;

a pull-in pulse generator that momentarily initiates a pull-in pulse when an input signal indicates a first state; and a sense resistor controller that controls current flow to bypass the sense resistor and to flow to the relay based on the pull-in pulse.

7. The system of claim 6 wherein the sense resistor controller, after the pull-in pulse completes, controls current to flow past the sense resistor.

8. The system of claim 7 further comprising:

a comparator that compares a voltage drop across the sense resistor to a reference voltage; and a fast turn-off system that regulates current flow to the relay based on the comparison.

9. The system of claim 8 wherein the fast turn-off system regulates current flow by passing current through a freewheeling path when the voltage drop is greater than the reference voltage.

10. The system of claim 8 wherein the fast turn-off system regulates current flow by passing current through a fast turn-off path when the input signal indicates a second state.

11. A control system that controls a relay, the system comprising:

a sense resistor that selectively communicates with the relay;

a pull-in pulse generator that momentarily initiates a pull-in pulse when an input signal indicates a first state;

a sense resistor controller that selectively controls current flow to one of flow through and bypass the sense resistor based on the pull-in pulse;

a comparator that compares a voltage drop across the sense resistor to a reference voltage; and a fast turn-off system that regulates current flow to the relay based on the comparison.

12. The system of claim 11 wherein the sense resistor controller, after the pull-in pulse completes, controls current to flow through the sense resistor.

13. The system of claim 11 wherein the fast turn-off system regulates current flow by passing current through a freewheeling path when the voltage drop is greater than the reference voltage.

14. The system of claim 11 wherein the fast turn-off system regulates current flow by passing current through a fast turn-off path when the input signal indicates a second state.

* * * * *